United States Patent [19]

Olstowski et al.

[11] Patent Number: 4,521,330

[45] Date of Patent: Jun. 4, 1985

[54] NON-AQUEOUS UREA-POLYETHER GEL COMPOSITIONS AND A METHOD FOR THEIR PREPARATION

[75] Inventors: Franciszek Olstowski, Freeport; Richard D. Peffley, Lake Jackson, both of Tex.

[73] Assignee: The Dow Chemical Company, Midland, Mich.

[21] Appl. No.: 531,555

[22] Filed: Sep. 12, 1983

[51] Int. Cl.[3] ..... C10M 1/20; C10M 1/32; C10M 1/44; C10M 1/50

[52] U.S. Cl. ..... 252/51.5 R; 252/49.6; 252/49.9; 252/51.5 A

[58] Field of Search ..... 252/49.6, 51.5 A, 49.9, 252/51.5 R

[56] References Cited

U.S. PATENT DOCUMENTS

| | | | |
|---|---|---|---|
| 3,085,081 | 4/1963 | Bailey, Jr. | 260/42 |
| 4,436,649 | 3/1984 | Stemke | 252/51.5 A |

OTHER PUBLICATIONS

Barker et al., "Solid Nonionic Surface-Active Agents", *J. of American Oil Chemist's Society*, vol. 32, No. 5, pp. 249-252, (May 1955).

Bailey et al., "Polyethylene Oxide", Academic Press, pp. 96, 97, (1976).

"Urea and Thiourea Adduction of $C_5$-$C_{42}$Hydrocarbons", *JACS*, vol. 74, pp. 1720-1723, 1952.

"Molecular Association Complexes of Polymers. Urea and Thiourea Complexes of High Molecular Weight Poly(Ethylene Oxide)", *Journal of Polymer Science*, vol. XLIX, pp. 397-406, (1961).

*Primary Examiner*—W. J. Shine

*Attorney, Agent, or Firm*—J. G. Carter; G. C. Cohn

[57] ABSTRACT

A method for gelling relatively high molecular weight polyoxyalkylene-containing materials having a block of at least about 10 weight percent of oxyethylene units by blending therewith a sufficient quantity of a relatively low molecular weight material having at least two hydroxyl groups per molecule containing urea dissolved therein.

7 Claims, No Drawings

NON-AQUEOUS UREA-POLYETHER GEL COMPOSITIONS AND A METHOD FOR THEIR PREPARATION

BACKGROUND OF THE INVENTION

The present invention pertains to a method for increasing the viscosity of or gelling liquid compositions and to the resultant compositions which have been increased in viscosity or gelled.

Urea has been known as a gelling agent for liquid materials, however, since the urea is a solid, the liquid material has to be heated for extended periods of time to dissolve enough of the urea to cause gellation or an increase in viscosity. It has now been discovered that if the urea is dissolved in a relatively low molecular weight hydroxyl-containing material and then adding this solution to the relatively high molecular weight material that it is not necessary to heat the relatively high molecular weight material and the time required for gellation is reduced.

SUMMARY OF THE INVENTION

One aspect of the present invention concerns a method for either increasing the viscosity of or gelling a composition which comprises (A) from about 10 to about 100%, preferably from about 20 to about 100% by weight of at least one relatively high molecular weight polyoxyalkylene-containing material having a molecular weight greater than about 500 and containing at least about 10% by weight of either an internal block or external block of oxyethylene (—O—$CH_2$—$CH_2$—) groups; and (B) from zero to about 90, preferably from about zero to about 80 weight percent of a member selected from the group consisting of (1) liquid relatively high molecular weight polyoxyalkylene-containing materials containing less than about 10 wt. % oxyethylene groups or an internal or terminal block;

(2) liquid hydrocarbon compounds, (3) liquid esters, (4) liquid halogenated hydrocarbon compounds, (5) liquid organo silicon compounds, (6) liquid organo phosphorous compounds, and (7) mixtures thereof;

which process comprises blending with the aforesaid composition a sufficient quantity of (C) a solution of (1) a relatively low equivalent weight material having a molecular weight less than about 500 and having from about 2 to about 8 hydroxyl groups per molecule containing (2) a sufficient quantity of urea to cause either an increase in viscosity over that of either of components (A) or (B) or cause gellation of the resultant mixture of components (A), (B) and (C) in a relatively short period of time.

Another aspect of the present invention pertains to gelled compositions which result from admixing (A) a composition comprising a mixture of (1) from about 20 to about 100%, preferably from about 30 to about 100% by weight of at least one relatively high molecular weight polyoxyalkylene-containing material having a molecular weight greater than about 500 and containing at least about 10% by weight of either an internal block or external block of oxyethylene (—O—$CH_2$—$CH_2$—) groups;

(2) from zero to about 80 weight percent of a member selected from the group consisting of (i) liquid relatively high molecular weight polyoxyalkylene-containing materials containing less than about 10 wt. % oxyethylene groups or an internal or terminal block;

(ii) liquid hydrocarbon compounds, (iii) liquid esters, (iv) liquid halogenated hydrocarbon compounds, (v) liquid organo silicon compounds, (vi) liquid organo phosphorous compounds, and (vii) mixtures thereof; and (3) from zero to an effective quantity of one or more solid or liquid components suitable for use as pharmacological agents, biocidal agents, lubricants, cosmetic agents or combinations thereof; and (B) a solution (1) a relatively low equivalent weight material having a molecular weight less than about 500 and having from about 2 to about 8 hydroxyl groups per molecule containing (2) a sufficient quantity of urea to cause either an increase in viscosity over that of component (A) or cause gellation of the resultant mixture of components (A) and (B) in a relatively short period of time.

DETAILED DESCRIPTION OF THE INVENTION

Suitable relatively high molecular weight polyoxyalkylene materials which can be employed herein include, for example, those liquid material represented by the formula $$Z\left(\left(O-CH_2-\underset{\underset{R}{|}}{CH}\right)_x\left(O-CH_2-\underset{\underset{R}{|}}{CH}\right)_y\left(O-CH_2-\underset{\underset{R}{|}}{CH}\right)_z OR'\right)_q$$

wherein each R is independently hydrogen, an alkyl group or a haloalkyl group having from about 1 to about 2 carbon atoms, a phenyl or a substituted phenyl group; each R′ is independently hydrogen, a hydrocarbon or substituted hydrocarbon group having from 1 to about 20, preferably from 1 to about 10 carbon atoms; Z is the residue of an initiator having from 1 to about 8, preferably from 1 to about 3, hydroxyl groups; g has a value from 1 to about 8; x, y and z have values such that the material has an average molecular weight greater than about 500 and are liquids at room temperature; and said material contains either an internal or a terminal block of oxyethylene groups corresponding to at least about 10 weight percent of said material.

These relatively high equivalent weight polyoxyalkylene-containing materials can be prepared by reacting an active hydrogen-containing initiator compound with one or more alkylene oxides or substituted alkylene oxides in any order of addition so long as the resultant material contains at least one internal or terminal block of oxyethylene (—O—$CH_2$—$CH_2$—) group in an amount of at least about 10% by weight. The material can have greater than 10% by weight total of the oxyethylene groups in random or block order of any length so long as the material contains the aforesaid at least one internal or terminal block of such oxyethylene groups amounting to at least about 10% by weight of such material.

Suitable initiator materials which can be employed to prepare the relatively high molecular weight materials include mono- and polyhydroxyl-containing compounds having from 1 to about 8 hydroxyl groups molecule such as, for example, water, ethylene glycol, propylene glycol, diethylene glycol, dipropylene glycol, glycerine, trimethylolpropane, pentaerythritol, sucrose, sorbitol, α-methyl glucoside, mixtures thereof and the like.

Suitable alkylene or substituted alkylene oxides which can be employed to prepare the relatively high molecular weight polyoxyalkylene materials include, for example, ethylene oxide, propylene oxide, 1,2-butylene oxide, 2,3-butylene oxide, styrene oxide, epichlorohydrin, epibromohydrin, methyl epichlorohydrin, mixtures thereof and the like.

Suitable materials in which the urea can be dissolved include liquid materials having from 2 to about 8 hydroxyl groups per molecule and an average molecular weight of less than about 500, preferably less than about 300. Particularly suitable materials include, for example, ethylene glycol, propylene glycol, diethylene glycol, 1,4-butane diol, 1,6-hexane diol, glycerine, trimethylolpropane, adducts of one or more alkylene oxides such as ethylene oxide, propylene oxide, butylene oxide with water or an initiator compound having two or more hydroxyl groups such as ethylene glycol, propylene glycol, glycerine, trimethylolpropane, sucrose, pentaerythritol, mixtures thereof and the like.

While the urea is usually not sufficiently soluble in the carrier materials or solvents therefor at room temperature so as to permit the introduction of a sufficient quantity of urea into the mixture with the relatively high molecular weight liquid material so as to cause gellation or an increase in viscosity, the solvent can be heated so as to permit a sufficient quantity of the urea to become dissolved therein. Then the hot solution containing the dissolved urea can be added to the relatively high molecular weight material liquid material which is at a temperature of from about 0° C. to about 50° C., preferably from about 20° C. to about 30° C.; or the urea-containing solution can be cooled prior to adding to the composition containing the relatively high molecular weight liquid material. However, since many of these urea-containing solutions act as super cooled liquids, care should be employed while handling them so as to prevent precipitation of the dissolved urea before the solution can be added.

The quantity of gelling viscosity increasing agent employed depends upon the composition of the liquid to be gelled or increased in viscosity and the concentration of urea in the solution which depends upon the solubility of urea in the particular solvent (hydroxyl-containing material) employed which depends upon the temperature at which the solution is prepared.

Suitable liquid hydrocarbon compounds which can be employed herein include aliphatic and aromatic hydrocarbons having from about 4 to about 16, preferably from about 6 to about 12 carbon atoms such as, for example, pentanes, hexanes, pentenes, hexenes, heptanes, heptenes, octanes, octenes, nonanes, nonenes, decanes, decenes, benzenes, toluene, xylene, mixtures thereof and the like.

Suitable liquid organosilicon compounds which can be employed herein include the liquid polysiloxanes, polymethylsiloxanes, and the like which are commercially available from Dow Corning Corporation, General Electric, Union Carbide Corporation and others.

Suitable liquid phosphorous-containing materials which can be employed herein include, for example, tri-n-butylphosphate, triethylphosphate, tris(2,3-dibromopropyl)phosphate, bis(2-chloroethyl)phosphate, tris(2-chloroethyl)phosphite, tributylphosphite, tricresylphosphate, tricresylphosphite, diethylisoamylphosphonate, dimethylmethylphosphonate, bis(2-bromopropyl)-2-bromopropane phosphonate, mixtures thereof and the like.

Suitable liquid esters which can be employed herein include those liquid esters prepared from organic carboxylic acid having from about 1 to about 20, preferably from about 1 to about 18 carbon atoms and alcohols having from about 1 to about 20, preferably from about 1 to about 18 carbon atoms. Particularly suitable esters include, for example, dioctyl phthalate, diethyl phthalate, diisodecyl phthalate, butyl benzyl phthalate, tri-2-ethylhexyl trimellitate, di-2-ethylhexyl adipate, dibutyl phthalate, butyl oleate, methyl oleate, amyl oleate, dibutyl sebucate, isooctyl palmitate, n-butyl stearate, dibutyl maleate, triethyl citrate, tri-n-butyl citrate, di-iso-butyl adipate, di-n-hexyl azelate, butyl laurate, mixtures thereof and the like.

Suitable liquid halogenated hydrocarbons which can be employed herein include, for example, methylene chloride, chloroform, perchloroethylene, tetrabromoethane, bromoform, hexachlorobutadiene tetrachlorobutane, 1,5-dibromopentane, 1,1,2-tribromopropane, polyepichlorohydrin diol having equivalent weight above about 200 up to about 4000, chlorinated paraffins, e.g. "Chlorowax" No. 40, isopropyl iodide, 1,3-dichloro-2-propanol, trichlorobenzene, tetrachlorodifluoroethane, mixtures thereof and the like.

The following materials were employed in the examples and comparative experiments.

Relatively High Molecular Weight Material

RHMWM A was a polyol prepared by reacting glycerine with propylene oxide and subsequently end capping with about 14 weight percent ethylene oxide and having about 70% primary hydroxyl groups and an average hydroxyl equivalent weight of about 1640.

RHMWM B was a polyol prepared by reacting glycerine with propylene oxide and subsequently end-capping with about 18 weight percent ethylene oxide and having about 77% primary hydroxyl groups and an average hydroxyl equivalent weight of about 1650.

RHMWM C was polyoxypropylene glycol end-capped with about 18 weight percent ethylene oxide and having a hydroxyl number of about 28.

RHMWM D was a mixture of about 93 weight percent RHMW Polyol B and about 7 weight percent of an aminated polyoxypropylene glycol having an average molecular weight of about 400. The aminated polyol is commercially available from Texas Chemical as Jeffamine D-400.

RHMWM E was a polyol prepared by reacting glycerine with propylene oxide to yield ~0.85 weight percent OH and subsequently capping this with about 19 weight percent ethylene oxide to yield a product that contains about 85% primary hydroxyl and an average hydroxyl number of about 23.

RHMWM F was a glycerine initiated polyoxypropylene triol having an average molecular weight of 3000.

RHMWM G was a polyoxybutylene diol having an average molecular weight of about 2000.

RHMWM H was a polyoxyethylene diol having an average molecular weight of 400.

RHMWM I was a polyoxyethylene diol having an average molecular weight of 600.

RHMWM J was a glycerine initiated polyoxypropylene triol containing a terminal block of about 10 wt. % oxyethylene groups and having an average molecular weight of about 3000.

RHMWM K was an n-butanol initiated polyoxybutylene monol containing a terminal block of about 28 wt. % oxyethylene groups and having an average molecular weight of about 610.

RHMWM L was a polyoxyalkylene material having an average molecular weight of about 1300 containing an internal block of about 46 wt. % oxyethylene groups prepared by reacting 1,2-butylene glycol with a polyoxyethylene glycol having an average molecular weight of about 600.

RHMWM M was a glycerine initiated polyoxypropylene triol having an average molecular weight of about 3000.

RHMWM N was polyoxypropylene glycol having an average molecular weight of about 2000.

The materials employed as a solvent for urea were:

Solvent A was ethylene glycol.

Solvent B was glycerine.

Solvent C was dipropylene glycol.

Solvent D was diethylene glycol.

Solvent E was an adduct of glycerine and propylene oxide having an average molecular weight of 450.

Solvent F was polyoxyethylene glycol having an average molecular weight of 400.

Solvent G was 1,4-butane diol.

Other Liquid Material (OLM) A was polyoxybutylene glycol having an average molecular weight of about 2000.

OLM B was glycerine initiated polyoxypropylene triol having an average molecular weight of about 3000.

OLM C was polyoxypropylene glycol having an average molecular weight of about 2000.

OLM D was VARSOL® #1 commercially available from Exxon Chemical Company.

OLM E was CHLOROWAX 40, a liquid chlorinated paraffin commercially available from Diamond Shamrock.

OLM F was dioctyl phthalate.

OLM G was a polysiloxane commerically available from Dow Corning Corporation as DC-550.

OLM H was tri(2,3-dibromopropyl)phosphate.

OLM I was dibutyl phosphate.

OLM J was perchloroethylene.

OLM K was triisooctyltrimellitate.

In the following examples and comparative experiments, the urea either as a solution or as a powder was added to the liquid relatively high molecular weight material or a mixture of such material and other liquid component(s) in a suitable container. The container was vigorously shaken to effect sufficient blending. The containers were then set aside and observed periodically. The urea solutions were prepared by dissolving in a suitable solvent at a temperature indicated in the following table which also provides the components, quantities employed and results.

TABLE

| | Ex. 1 | Comp. Expt. A | Ex. 2 | Ex. 3 | Comp. Expt. B | Comp. Expt. C | Ex. 4 | Ex. 5 |
|---|---|---|---|---|---|---|---|---|
| RELATIVELY HIGH MOLECULAR WEIGHT LIQUID MATERIAL Type/pbw | A/99 | A/199 | A/98 | A/95 | A/49 | A/45 | B/99 | B/97 |
| OTHER LIQUID MATERIAL Type/pbw | | | | | | | | |
| UREA SOLUTION, pbw | 1 | 1 | 2 | 5 | 1 | 5 | 1 | 3 |
| SOLVENT TYPE | A | NONE | A | A | NONE | NONE | A | A |
| conc. of urea, wt % | 40 | 100 | 40 | 40 | 100 | 100 | 40 | 40 |
| temp. at which soln. was prepared, °C. | | — | | | — | | | |
| WT % UREA IN TOTAL COMPOSITION | 0.4 | 0.5 | 0.8 | 2 | 2 | 10 | 0.4 | 1.2 |
| RESULTS | GELLED >15 min. <16 hrs. | NO GEL in 5 days | GELLED in ~2 min. | GELLED in ~2 min. | NO GEL in 5 days | GELLED in ~24 hrs. | GELLED >15 min. <16 hrs. | GELLED in <5 min. |
| pour point of gell, °C. | — | — | — | — | — | — | — | — |

| | Comp. Expt. D | Ex. 6 | Comp. Expt. E | Ex. 7 | Comp. Expt. F | Ex. 8 | Comp. Expt. G | Comp. Expt. H |
|---|---|---|---|---|---|---|---|---|
| RELATIVELY HIGH MOLECULAR WEIGHT LIQUID MATERIAL Type/pbw | B/45 | C/48 | C/49 | C/100 | C/45 | D/48 | D/49 | D/45 |
| OTHER LIQUID MATERIAL Type/pbw | | | | | | | | |
| UREA SOLUTION, pbw | 5 | 2 | 1 | 9.8 | 5 | 2 | 1 | 5 |
| SOLVENT TYPE | NONE | A | NONE | A | NONE | A | NONE | NONE |
| conc. of urea, wt % | 100 | 40 | 100 | 40 | 100 | 40 | 110 | 100 |
| temp. at which soln. was prepared, °C. | — | | — | | | | — | — |
| WT % UREA IN TOTAL COMPOSITION | 10 | 2 | 2 | 5 | 10 | 1.6 | 2 | 10 |
| RESULTS | GELLED in 9 hrs. | GELLED in <5 min. | NO GEL in 5 days | GELLED in ~2 min. | NO GEL in 6 hrs. | GELLED in <15 min. | NO GEL in 5 days | GELLED in ~2 hrs. |

TABLE-continued

| | | | | | | | | |
|---|---|---|---|---|---|---|---|---|
| | | | | | Gelled in <24 hrs. | | | |
| pour point of gell, °C. | — | — | — | — | — | — | — | — |

| | Ex. 9 | Comp. Expt. I | Ex. 10 | Comp. Expt. J | Comp. Expt. K | Ex. 11 | Ex. 12 | Ex. 13 |
|---|---|---|---|---|---|---|---|---|
| RELATIVELY HIGH MOLECULAR WEIGHT LIQUID MATERIAL Type/pbw | E/49.5 | E/199 | E/48 | E/49 | E/45 | A/48 | A/45 | A/40 |
| OTHER LIQUID MATERIAL Type/pbw | | | | | | | | |
| UREA SOLUTION, pbw | 0.5 | 1 | 2 | 1 | 5 | 2 | 5 | 10 |
| SOLVENT TYPE | A | NONE | A | NONE | NONE | A | A | A |
| conc. of urea, wt % | 40 | 100 | 40 | 100 | 100 | 50 | 50 | 50 |
| temp. at which soln. was prepared, °C. | | — | | — | — | 70–90 | 70–90 | 70–90 |
| WT % UREA IN TOTAL COMPOSITION | 0.4 | 0.5 | 1.6 | 2 | 10 | 2 | 5 | 10 |
| RESULTS | GELLED in <2 min. | STILL liquid after 5 days | GELLED in <2 min. | GELLED in >24 hrs. <48 hrs. | GELLED in ~2 hrs. | TRANS-LUCENT non-pourable product in 1½ hrs. | NON-POUR-ABLE product in 1½ hrs. | OPAQUE non-pourable product in 1½ hrs. |
| pour point of gell, °C. | — | — | — | — | — | 72 | 69 | 65 |

| | Ex. 14 | Ex. 15 | Ex. 16 | Ex. 17 | Ex. 18 | Ex. 19 | Ex. 20 | Ex. 21 | Ex. 22 |
|---|---|---|---|---|---|---|---|---|---|
| RELATIVELY HIGH MOLECULAR WEIGHT LIQUID MATERIAL Type/pbw | A/30 | A/30 | A/25 | A/20 | A/40 | A/40 | A/40 | E/40 | E/40 |
| OTHER LIQUID MATERIAL Type/pbw | | | | | | | | | |
| UREA SOLUTION, pbw | 10 | 15 | 25 | 40 | 10 | 10 | 10 | 10 | 10 |
| SOLVENT TYPE | A | A | A | A | A | A | A | A | A |
| conc. of urea, wt % | 50 | 50 | 50 | 50 | 35 | 25 | 10 | 25 | 15 |
| temp. at which soln. was prepared, °C. | 70–90 | 70–90 | 70–90 | 70–90 | ~25 | ~25 | ~25 | ~25 | ~25 |
| WT % UREA IN TOTAL COMPOSITION | 12.5 | 16.7 | 25 | 33.3 | 4.7 | 3.8 | 2 | 7.7 | 2.3 |
| RESULTS | OPAQUE non-pourable product in 1½ hrs. | OPAQUE non-pourable product in 1½ hrs. | OPAQUE non-pourable product in 1½ hrs. | Opaque Non-pourable product in 1½ hrs. | High Viscos-ity clear liquid | Viscos-ity less than that of Ex. 18 | Viscosity lower than that of Ex. 19 but greater than that of RHMWM A | Clear gel in <3 min. | Clear gel in <3 min. |
| pour point of gell, °C. | — | — | 59 | <59 but >54 | — | — | — | — | — |

| | Ex. 23 | Comp. Expt. L | Comp. Expt. M | Comp Expt. N | Comp Expt. O | Ex. 24 | Ex. 25 | Ex. 26 | Ex. 27 | Ex. 28 |
|---|---|---|---|---|---|---|---|---|---|---|
| RELATIVELY HIGH MOLECULAR WEIGHT LIQUID MATERIAL Type/pbw | E/40 | F/90 | G/100 | H/100 | I/45 | B/48 | E/42 | B/45 | E/40 | A/40 |
| OTHER LIQUID MATERIAL Type/pbw | | | | | | | | | | |
| UREA SOLUTION, pbw | 10 | 15 | 4 | 28 | 5 | 2 | 3 | 5 | 5 | 10 |
| SOLVENT TYPE | A | A | A | A | A | B | C | D | E | E |
| conc. of urea, wt % | 10 | 40 | 40 | 40 | 40 | 40 | 20 | 33.3 | 10 | 10 |
| temp. at which soln. was prepared, °C. | ~25 | 60 | 60 | 60 | 60 | 100 | 100 | 100 | 100 | 100 |
| WT % UREA IN TOTAL COMPOSITION | 2 | 3.2 | 1.5 | 8.75 | 4 | 1.6 | 1.3 | 2.1 | 1.1 | 2 |
| RESULTS | High Viscos-ity trans-lucent liquid | No gell-ation or sub-stantial increase in vis-cosity after 5 days | No gell-ation or substan-tial in-crease in vis-cosity after 5 days. Noted a separation | No gell-ation or substan-tial in-crease in vis-cosity was ob-served in 5 days | No gell-ation or substan-tial in-crease in vis-cosity was ob-served in 5 days | Gelled in <24 hours | Gelled in <2 min. | Gelled in 2 hours | Gelled in 30 min. | Viscosity increased in 1 hour. The vis-cous liquid contained small gel particles |

TABLE-continued

| | | | | | | | | | |
|---|---|---|---|---|---|---|---|---|---|
| | | | of liquid phase | | | | | | |
| pour point of gell, °C. | — | — | — | — | — | — | — | — | — |

| | Ex. 29 | Ex. 30 | Ex. 31 | Ex. 32 | Ex. 33 | Ex. 34 | Ex. 35 | Ex. 36 | Ex. 37 |
|---|---|---|---|---|---|---|---|---|---|
| RELATIVELY HIGH MOLECULAR WEIGHT LIQUID MATERIAL Type/pbw | B/98 | D/100 | J/45 | K/20 | L/45 | A/15 | B/5 | A/20 | A/5 |
| OTHER LIQUID MATERIAL Type/pbw | | | | | | A/10 | A/20 | B/25 | B/43 |
| UREA SOLUTION, pbw | 2 | 22 | 5 | 1 | 5 | 1 | 1 | 5 | 2 |
| SOLVENT TYPE | F | G | A | A | A | A | A | A | A |
| conc. of urea, wt % | 20 | 20 | 40 | 40 | 40 | 40 | 40 | 40 | 40 |
| temp. at which soln. was prepared, °C. | 120 | 80 | 60 | 40 | 60 | 60 | 60 | 60 | 60 |
| WT % UREA IN TOTAL COMPOSITION | 0.4 | 3.6 | 4 | 1.9 | 4 | 1.5 | 1.5 | 4 | 1.6 |
| RESULTS | Gel-like product having viscosity greater than RHMWM or urea solution in 16 hours. | Translucent gel in <24 hours. | Non-pourable product in <1 hour. | Non-pourable product in <1 hour. | Gelled into an opaque solid in <5 min. | Gel-like non-pourable product in <10 min. | Formed a gel in <1 hour. | Non-pourable product in about 1 hour. | Substantial increase in viscosity in about 2 hours. |
| pour point of gell, °C. | — | — | — | | | — | — | — | — |

| | Ex. 38 | Ex. 39 | Ex. 40 | Ex. 41 | Ex. 42 | Ex. 43 | Comp. Expt. N | Ex. 44 |
|---|---|---|---|---|---|---|---|---|
| RELATIVELY HIGH MOLECULAR WEIGHT LIQUID MATERIAL Type/pbw | E/8 N/20 | B/30 | B/25 | A/20 | B/30 | A/25 | A/10 | A/20 |
| OTHER LIQUID MATERIAL Type/pbw | A/20 | D/30 | E/25 | E/30 | F/30 | G/25 | G/40 | H/30 |
| UREA SOLUTION, pbw | 2 | 6 | 5 | 4 | 6 | 5 | 2 | 4 |
| SOLVENT TYPE | A | A | A | A | A | A | A | A |
| conc. of urea, wt % | 40 | 40 | 40 | 40 | 40 | 40 | 40 | 40 |
| temp. at which soln. was prepared, °C. | 60 | 60 | 60 | 60 | 60 | 60 | 60 | 60 |
| WT % UREA IN TOTAL COMPOSITION | 0.8 | 3.6 | 3.6 | 3 | 3.6 | 3.6 | 1.5 | 2.9 |
| RESULTS | Formed a non-pourable gel in <4 hrs. | Formed a non-pourable gel in <1 hour. | Formed a non-pourable gel in <1 hour. | Formed a non-pourable product in <24 hours. | Formed a non-pourable product in 1 hour. | Formed a non-pourable product in 1 hour. | Product did not gel or increase in viscosity in after 24 hours. | Mixture formed a non-pourable product in <1 hr. |
| pour point of gell, °C. | — | — | — | — | — | — | — | — |

| | Ex. 45 | Comp. Expt. O | Ex. 46 | Ex. 47 |
|---|---|---|---|---|
| RELATIVELY HIGH MOLECULAR WEIGHT LIQUID MATERIAL Type/pbw | A/40 | A/5 | A/25 | A/20 |
| OTHER LIQUID MATERIAL Type/pbw | I/10 | I/5 | J/25 | E/10<br>G/10<br>H/10<br>K/10 |
| UREA SOLUTION, pbw | 5 | 1 | 5 | 5 |
| SOLVENT TYPE | A | A | A | A |
| conc. of urea, wt % | 40 | 40 | 40 | 40 |
| temp. at which soln. was prepared, °C. | 60 | 60 | 60 | 60 |
| WT % UREA IN TOTAL COMPOSITION | 3.6 | 3.6 | 3.6 | 3 |
| RESULTS | Formed a gel in <24 hrs. | Mixture formed an opaque pourable fluid with no apparent increase in viscosity in 24 hours. | Formed a non-pourable product in <48 hrs. | Formed a non-pourable product in <30 min. |

TABLE-continued

| | | | | |
|---|---|---|---|---|
| pour point of gell, °C. | — | — | — | — |

EXAMPLE 48

A non-separating flake graphite containing composition was prepared by blending the following:

60 parts RHMWM E
70 parts OLM D
40 parts Dixon #635 Flake graphite then 20 parts of 40 wt. % urea in ethylene glycol (preheated to 60° C.) was blended into the above mixture. This compositition was observed to have formed a non-segregating graphite containing gel in less than 20 hours. A portion of this product was inserted into a sealed gearbox and functioned as the sole lubricant in this application.

COMPARATIVE EXPERIMENT P

A comparative blend was prepared by mixing the following:

60 parts Voranol* 5148
70 parts Vargol #1
40 parts Dixon #635 flake graphite

About 20 hours later, the above blend was noticed to have separated into 2 layers: An upper clear liquid (approx. 50% by volume) and a lower layer containing the settled graphite.

We claim:

1. A method for either increasing the viscosity of or gelling a composition which comprises
   (A) from about 10 to about 100%, by weight of at least one relatively high molecular weight polyoxyalkylene-containing material having a molecular weight greater than about 500 and containing at least about 10% by weight of either an internal block or external block of oxyethylene (—O—$CH_2$—$CH_2$—) groups; and
   (B) from zero to about 90, weight percent of a member selected from the group consisting of
      (1) liquid relatively high molecular weight polyoxyalkylene-containing materials containing less than about 10 wt. % oxyethylene groups or an internal or terminal block;
      (2) liquid hydrocarbon compounds,
      (3) liquid esters,
      (4) liquid halogenated hydrocarbon compounds,
      (5) liquid organo silicon compounds,
      (6) liquid organo phosphorous compounds, and
      (7) mixtures thereof;

which process comprises blending with the aforesaid composition a sufficient quantity of (C) a solution of
      (1) a relatively low equivalent weight material having a molecular weight less than about 500 and having from about 2 to about 8 hydroxyl groups per molecule containing
      (2) a sufficient quantity of urea to cause either an increase in viscosity over that of either of components (A) or (B) or cause gellation of the resultant mixture of components (A), (B) and (C) in a relatively short period of time.

2. A method of claim 1 wherein component (A) is present in a quantity of from about 20 to about 100% by weight and component (B) is present in a quantity of from about zero to about 80 percent by weight.

3. A method of claim 2 wherein component (A) is a material or mixture of materials represented by the formula $$Z\left(\left(O-CH_2-\underset{\underset{R}{|}}{CH}\right)_x\left(O-CH_2-\underset{\underset{R}{|}}{CH}\right)_y\left(O-CH_2-\underset{\underset{R}{|}}{CH}\right)_z OR'\right)_q$$

wherein each R is independently hydrogen, an alkyl group or a haloalkyl group having from about 1 to about 2 carbon atoms, a phenyl or a substituted phenyl group; each R′ is independently hydrogen, a hydrocarbon or substituted hydrocarbon group having from 1 to about 20 carbon atoms; Z is the residue of an initiator having from 1 to about 8 hydroxyl groups before reaction; q has a value from 1 to about 8; x, y and z have values such that the material has an average molecular weight greater than about 500 and are liquids at room temperature; and said material contains either an internal or a terminal block of oxyethylene groups corresponding to at least 10 weight percent of said material.

4. A method of claim 3 wherein each R is independently hydrogen, methyl or ethyl; each R′ is independently hydrogen or a hydrocarbon group having from 1 to about 10 carbon atoms; Z is the residue of an initiator having from about 1 to about 8 hydroxyl groups; q has a value from about 1 to 8; x, y and z have values such that the material has an average molecular weight greater than about 500.

5. A method of claim 4 wherein Z is the residue of an initiator having from 1 to 3 hydroxyl groups.

6. A gelled composition prepared according to the method of claim 1.

7. A gelled composition prepared according to the method of claim 5.

* * * * *